US009121375B2

(12) United States Patent
Ishii et al.

(10) Patent No.: US 9,121,375 B2
(45) Date of Patent: Sep. 1, 2015

(54) AIR INTAKE CONTROL VALVE AND AIR INTAKE APPARATUS

(71) Applicant: AISIN SEIKI KABUSHIKI KAISHA, Kariya-shi (JP)

(72) Inventors: Masato Ishii, Kariya (JP); Takuya Kato, Kariya (JP); Shinichi Oya, Kariya (JP); Masaru Inoue, Kariya (JP)

(73) Assignee: AISIN SEIKI KABUSHIKI KAISHA, Kariya-shi, Aichi-ken (JP)

( * ) Notice: Subject to any disclaimer, the term of this patent is extended or adjusted under 35 U.S.C. 154(b) by 376 days.

(21) Appl. No.: 13/666,384

(22) Filed: Nov. 1, 2012

(65) Prior Publication Data

US 2014/0116377 A1 May 1, 2014

(51) Int. Cl.

| | |
|---|---|
| ***F02M 35/00*** | (2006.01) |
| ***F02M 35/10*** | (2006.01) |
| ***F02M 35/116*** | (2006.01) |
| ***F02D 9/10*** | (2006.01) |

(52) U.S. Cl.

CPC ..... *F02M 35/10321* (2013.01); *F02D 9/107* (2013.01); *F02M 35/10045* (2013.01); *F02M 35/10347* (2013.01); *F02M 35/116* (2013.01)

(58) Field of Classification Search

CPC ..... F02M 35/10045; F02M 35/10321; F02M 35/10347; F02D 9/107

USPC ..... 123/337, 184.26, 184.36, 184.44, 123/184.49, 184.51, 184.53, 184.55, 123/184.56, 184.59

See application file for complete search history.

(56) References Cited

U.S. PATENT DOCUMENTS

| | | | | |
|---|---|---|---|---|
| 4,794,886 | A * | 1/1989 | Iwamuro et al. | 123/184.49 |
| 6,722,335 | B2 * | 4/2004 | Nomura et al. | 123/184.59 |
| 6,796,280 | B2 * | 9/2004 | Yamamoto et al. | 123/184.36 |
| 7,137,614 | B2 * | 11/2006 | Masui et al. | 251/129.11 |
| 8,714,522 | B2 * | 5/2014 | Hasegawa et al. | 251/306 |
| 2002/0195076 | A1 * | 12/2002 | Nomizo et al. | 123/184.57 |
| 2011/0308640 | A1 | 12/2011 | Hasegawa et al. | |
| 2012/0132169 | A1 | 5/2012 | Ishii et al. | |

FOREIGN PATENT DOCUMENTS

| | | | |
|---|---|---|---|
| JP | 2008-144768 | A | 6/2008 |

* cited by examiner

*Primary Examiner* — Hai Huynh

(74) *Attorney, Agent, or Firm* — Buchanan Ingersoll & Rooney PC

(57) ABSTRACT

This air intake control valve includes a valve body rotatably mounted on a surge tank of an internal-combustion engine, rotated between an open position and a closed position to open and close a fluid passage formed in a partition wall internally dividing the surge tank into two parts and a valve body sealing member arranged on the outer periphery of the valve body, providing a seal between the partition wall and the valve body by coming into contact with the partition wall of the surge tank at the closed position of the valve body.

18 Claims, 8 Drawing Sheets

FIG.6 STATE OF SUPPORTING FIRST END PORTION SIDE (Y2 DIRECTION SIDE) OF VALVE BODY
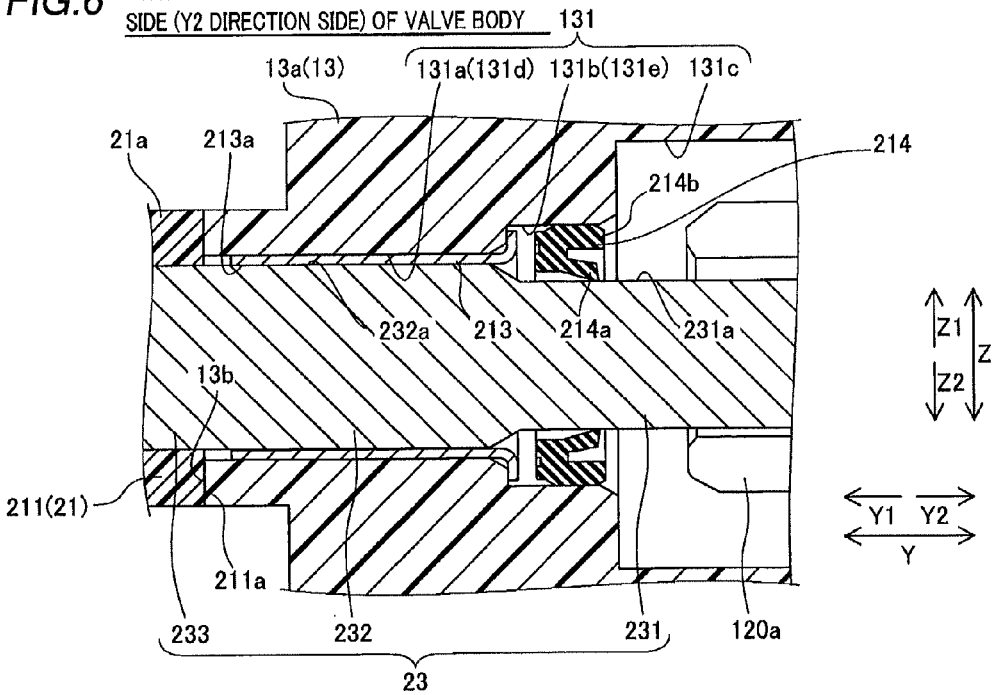
FIG.7 STATE OF VALVE BODY AT OPEN POSITION (VII-VII CROSS-SECTION)
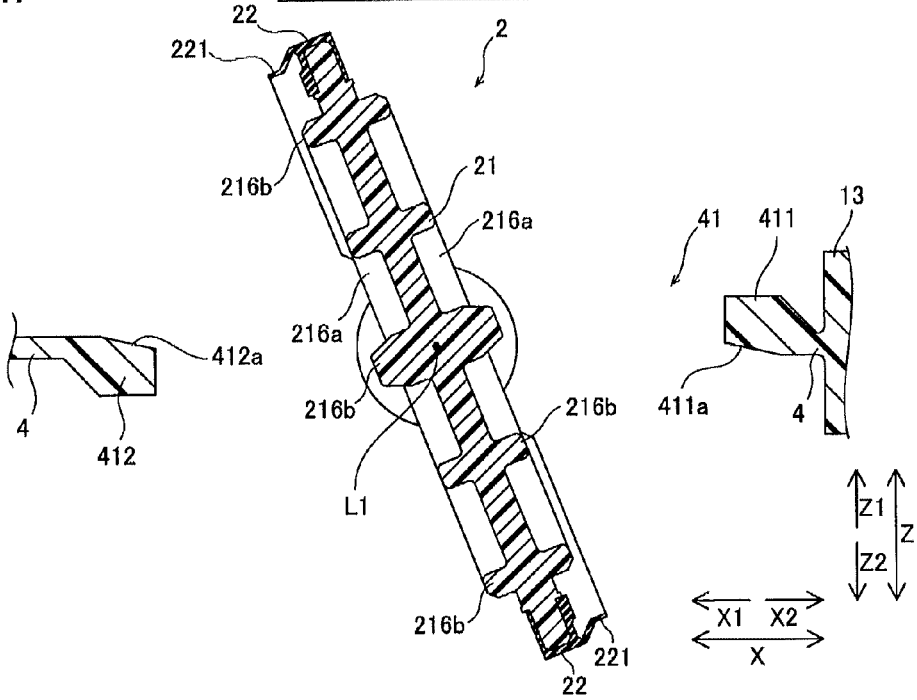

STATE OF VALVE BODY AT CLOSED POSITION
(VIII-VIII CROSS-SECTION)

STATE OF SUPPORTING SECOND END PORTION SIDE
(Y1 DIRECTION SIDE) OF VALVE BODY

MODIFICATION IN WHICH CONCAVE ESCAPE PORTION IS CONCAVE UPWARD

AIR INTAKE CONTROL VALVE AND AIR INTAKE APPARATUS

BACKGROUND OF THE INVENTION

1. Field of the Invention

The present invention relates to an air intake control valve and an air intake apparatus.

2. Description of the Background Art

In general, an air intake control valve including a valve body to open and close a fluid passage is known. Such an air intake control valve is disclosed in Japanese Patent Laying-Open No. 2008-144768, for example.

In the aforementioned Japanese Patent Laying-Open No. 2008-144768, there is disclosed a control valve (air intake control valve) including a frame-shaped body (frame) formed with an air intake passage (fluid passage) and a valve (valve body) supported by the frame-shaped body, rotated between an open position and a closed position to open and close the air intake passage of the body.

Furthermore, in general, the structure of a surge tank of an internal-combustion engine internally divided into two spaces by a partition wall, in which the conventional control valve (air intake control valve) described in the aforementioned Japanese Patent Laying-Open No. 2008-144768 is provided in an opening portion formed in the partition wall in order to change the resonance frequency of an air intake system to obtain an effective supercharging effect in a wide engine operation range, is known. In this structure, the frame-shaped body (frame) in a state where the valve is mounted thereon is fitted into the opening portion of the partition wall, the two spaces in the surge tank communicate with each other through the air intake passage formed in the body by rotating the valve supported by the body to the open position, and the two spaces are separated from each other by rotating the valve to the closed position to close the air intake passage.

In the aforementioned conventional structure, however, the air intake passage formed in the frame-shaped body (frame) fitted into the opening portion formed in the partition wall is opened and closed by the valve, and hence there is such inconvenience that it is difficult to sufficiently increase the opening area of the air intake passage opened and closed by the valve. In other words, it is difficult to enlarge the opening portion of the partition wall in the surge tank having a limited space and it is necessary to fit the frame-shaped body into the opening portion, so that the opening area of the air intake passage (fluid passage) is reduced by the width of the frame-shaped body from the opening area of the opening portion of the partition wall. Therefore, when the valve is so rotated to the open position that the two spaces communicate with each other, the opening area of the air intake passage is reduced so that the pressure loss of intake air circulating through the air intake passage is increased. Thus, there is such a problem that the amount of intake air circulating through the air intake passage is reduced and a sufficient supercharging effect cannot be obtained. Furthermore, in the aforementioned conventional structure, the frame-shaped body is fitted into the opening portion of the partition wall in a state where a gasket is generally provided along the outer peripheral surface of the frame-shaped body in order to prevent intake air from leaking from a clearance between the inner peripheral surface of the opening portion of the partition wall and the outer peripheral surface of the frame-shaped body (frame). In this case, the opening area of the air intake passage (fluid passage) is reduced by the thickness of the gasket in addition to the width of the frame-shaped body (frame), and hence there is such a problem that the amount of intake air circulating through the air intake passage is further reduced.

SUMMARY OF THE INVENTION

The present invention has been proposed in order to solve the aforementioned problems, and an object of the present invention is to provide an air intake control valve and an air intake apparatus each capable of increasing the amount of intake air circulating through a fluid passage between two spaces in a surge tank to improve a supercharging effect when a valve body is so rotated to an open position that the two spaces communicate with each other.

In order to attain the aforementioned object, an air intake control valve according to a first aspect of the present invention includes a valve body rotatably mounted on a surge tank of an internal-combustion engine, rotated between an open position and a closed position to open and close a fluid passage formed in a partition wall internally dividing the surge tank into two parts and a valve body sealing member arranged on the outer periphery of the valve body, providing a seal between the partition wall and the valve body by coming into contact with the partition wall of the surge tank at the closed position of the valve body.

As hereinabove described, the air intake control valve according to the first aspect of the present invention is provided with the valve body rotated between the open position and the closed position to open and close the fluid passage formed in the partition wall internally dividing the surge tank into two parts and the valve body sealing member arranged on the outer periphery of the valve body, providing a seal between the partition wall and the valve body by coming into contact with the partition wall of the surge tank at the closed position of the valve body, whereby the fluid passage (opening portion) formed in the partition wall can be closed by the valve body in a state where the valve body sealing member provides a seal between the partition wall and the valve body when the valve body is rotated to the closed position. Thus, the opening portion formed in the partition wall can be directly used as the fluid passage opened and closed by the valve body. In other words, dissimilarly to the structure in which the fluid passage formed in a frame-shaped body (frame) is opened and closed by the valve body, it is not necessary to render the opening area of the fluid passage opened and closed by the valve body smaller than the opening area of the opening portion formed in the partition wall, and hence the opening area of the fluid passage can be increased. Thus, when the valve body is so rotated to the open position that two spaces communicate with each other, the opening area of the fluid passage is increased so that the pressure loss of intake air circulating through the fluid passage can be reduced. Thus, the amount of intake air circulating through the fluid passage can be increased to improve a supercharging effect. Furthermore, no gasket may be provided on the outer peripheral surface of the frame-shaped body (frame) or a body, and hence the number of components can be reduced to simplify the structure and also simplify steps of mounting the air intake control valve.

Preferably in the aforementioned air intake control valve according to the first aspect, the valve body sealing member is configured to come into contact with a sealing surface provided along an edge portion of the fluid passage of the partition wall of the surge tank. According to this structure, the valve body sealing member can accurately provide a seal by coming into contact with the sealing surface of the partition wall when the valve body is rotated to the closed position, and hence intake air can be further inhibited from leaking from a clearance between the partition wall and the valve body.

Preferably in the aforementioned air intake control valve according to the first aspect, the valve body is configured to rotate about a rotation shaft line, and both a first end portion and a second end portion of the valve body in the extensional direction of the rotation shaft line are configured to be rotatably supported by the surge tank. According to this structure, both the first end portion and the second end portion of the valve body are supported by only the surge tank without separately providing a member supporting the valve body such as the frame-shaped body (frame), so that the valve body can be stably rotated about the rotation shaft line.

Preferably in this case, the first end portion of the valve body is configured to be rotatably supported by an outer peripheral wall of the surge tank, and the second end portion of the valve body is configured to be rotatably supported by the partition wall of the surge tank. According to this structure, both end portions of the valve body can be easily rotatably supported by utilizing the outer peripheral wall and the partition wall of the surge tank.

Preferably in the aforementioned structure in which both the first end portion and the second end portion of the valve body are rotatably supported by the surge tank, the valve body has a shape symmetric with respect to both the rotation shaft line and a centerline in a direction orthogonal to the rotation shaft line in a state where both the first end portion and the second end portion of the valve body are rotatably supported by the surge tank. According to this structure, the plane area of the valve body can be effectively increased in the surge tank having a limited space, and hence the opening area of the fluid passage opened and closed by the valve body can be further increased. Consequently, the amount of intake air circulating through the fluid passage can be further increased when the valve body is so rotated to the open position that the two spaces communicate with each other, and hence a supercharging effect can be further improved. Furthermore, the weight of the valve body can be symmetrically allocated in both the extensional direction of the rotation shaft line and the direction orthogonal to the rotation shaft line, and hence the valve body can be more stably rotated in the opening and closing operation of the valve body.

Preferably in the aforementioned structure in which both the first end portion and the second end portion of the valve body are rotatably supported by the surge tank, either a rotation shaft or a shaft bearing is integrally provided on each of the first end portion and the second end portion of the valve body. According to this structure, the steps of mounting the air intake control valve can be simplified as compared with a case where the rotation shaft or the shaft bearing is provided separately from the valve body.

Preferably in the aforementioned structure in which either the rotation shaft or the shaft bearing is integrally provided on each of the first end portion and the second end portion of the valve body, the rotation shaft rotating together with the valve body is integrally provided on the first end portion of the valve body, a first shaft bearing is integrally provided on the second end portion of the valve body, and the rotation shaft of the valve body is rotatably supported by a second shaft bearing fixed to a rotation shaft support portion provided on an outer peripheral wall of the surge tank while the first shaft bearing of the valve body is rotatably supported by a shaft member fixed to a shaft member fixing portion of the partition wall of the surge tank. According to this structure, it is only necessary to insert the shaft member into the first shaft bearing of the second end portion after the rotation shaft of the first end portion of the valve body is inserted into the rotation shaft support portion (rotation shaft support hole) of the surge tank, and hence the valve body can be easily mounted on the surge tank, dissimilarly to a case where rotation shafts integrally provided on both ends of the valve body are simultaneously mounted in support holes of the surge tank.

Preferably in the aforementioned structure in which the rotation shaft and the first shaft bearing are integrally provided on the first end portion and the second end portion of the valve body, respectively, the valve body is made of resin, and both the rotation shaft and the first shaft bearing are made of metal and are integrally formed on the valve body when the valve body is resin-molded. According to this embodiment, the rotation shaft and the first shaft bearing each made of metal excellent in wear resistance can be easily integrally provided on the first end portion and the second end portion of the valve body made of resin, respectively, and hence the valve body can be inhibited from being unstably rotated due to wear of the rotation shaft and the first shaft bearing, dissimilarly to a case where the rotation shaft and the first shaft bearing are made of the same resin as the valve body and are integrally formed on the valve body.

Preferably in the aforementioned structure in which the rotation shaft and the first shaft bearing are integrally provided on the first end portion and the second end portion of the valve body, respectively, the second shaft bearing is inserted into and mounted in a clearance between the outer peripheral surface of the rotation shaft and the inner peripheral surface of the rotation shaft support hole in a state where the rotation shaft is inserted into a rotation shaft support hole of the rotation shaft support portion, so that the rotation shaft is rotatably supported by the second shaft bearing. According to this structure, the rotation shaft of the valve body is rotatably supported by the second shaft bearing in a state where the second shaft bearing fills the clearance between the outer peripheral surface of the rotation shaft and the inner peripheral surface of the rotation shaft support hole, and hence backlash of the rotation shaft is suppressed, so that the valve body can be stably rotated. Furthermore, the inner diameter of the rotation shaft support hole can be rendered larger than the outer diameter of the rotation shaft, and hence the rotation shaft can be easily inserted into the rotation shaft support hole in a state where the second shaft bearing of the valve body is not inserted.

Preferably in the aforementioned structure in which the second shaft bearing is inserted into the clearance between the outer peripheral surface of the rotation shaft and the inner peripheral surface of the rotation shaft support hole, a rotation shaft sealing member is mounted in the clearance between the outer peripheral surface of the rotation shaft and the inner peripheral surface of the rotation shaft support hole outside a portion of the rotation shaft support hole mounted with the second shaft bearing. According to this structure, the rotation shaft sealing member arranged outside the second shaft bearing can prevent outside air from flowing into the surge tank from the outside through the clearance between the outer peripheral surface of the rotation shaft and the inner peripheral surface of the rotation shaft support hole, and hence an air-fuel ratio can be inhibited from deviating from a designed value due to inflow of outside air.

Preferably in the aforementioned structure in which the rotation shaft sealing member is provided, the rotation shaft is so configured that the outer peripheral surface of the rotation shaft comes into line contact with an annular projecting portion of the rotation shaft sealing member. According to this structure, the contact area between the outer peripheral surface of the rotation shaft and the rotation shaft sealing member can be reduced as compared with a case where the rotation shaft sealing member comes into surface contact with the outer peripheral surface of the rotation shaft, and hence the rotational resistance of the rotation shaft can be inhibited from increasing due to contact with the rotation shaft sealing member.

Preferably in the aforementioned structure in which the rotation shaft and the first shaft bearing are integrally provided on the first end portion and the second end portion of the valve body, respectively, a bush member made of metal is integrally provided on the shaft member fixing portion of the partition wall, and the first shaft bearing of the valve body is rotatably supported by the shaft member fixed by being press-fitted into the bush member made of metal. According to this structure, the shaft member supporting the first shaft bearing of the valve body can be tightly fixed by the bush member made of metal that is hard to deform (expand and contract), and hence the tightly fixed shaft member can stably support the first shaft bearing of the valve body.

Preferably in the aforementioned structure in which the rotation shaft and the first shaft bearing are integrally provided on the first end portion and the second end portion of the valve body, respectively, the rotation shaft of the valve body is provided to project outward from the rotation shaft support portion of the outer peripheral wall of the surge tank in a state where the rotation shaft is rotatably mounted on the surge tank, and an actuator rotating the rotation shaft is mounted on a portion of the rotation shaft projecting outward from the rotation shaft support portion of the surge tank. According to this structure, the actuator arranged outside the surge tank can easily rotate the valve body rotatably supported by the surge tank in the surge tank.

Preferably in the aforementioned structure in which the rotation shaft and the first shaft bearing are integrally provided on the first end portion and the second end portion of the valve body, respectively, the valve body includes a rotation shaft holding portion holding the rotation shaft, being opposed to and coming into contact with the rotation shaft support portion and a shaft bearing holding portion holding the first shaft bearing, being opposed to and coming into contact with the shaft member fixing portion of the partition wall. According to this structure, intake air can be inhibited from leaking from clearances between the rotation shaft support portion of the surge tank and the rotation shaft holding portion of the valve body and between the shaft member fixing portion of the partition wall and the shaft bearing holding portion of the valve body without providing sealing members therebetween.

Preferably in the aforementioned structure in which the rotation shaft and the first shaft bearing are integrally provided on the first end portion and the second end portion of the valve body, respectively, a tapered portion tapered toward the tip of the second end portion is provided at least in the vicinity of the second end portion of the valve body integrally provided with the first shaft bearing. According to this structure, the amount of protrusion of a corner portion closer to the second end portion is reduced by the tapered portion, and hence when the valve body is mounted on a prescribed position of the fluid passage, the second end portion provided with the first shaft bearing can be easily inserted into the fluid passage while the valve body is inclined even after the rotation shaft provided on the first end portion is arranged on the rotation shaft support portion of the surge tank. Thus, the valve body can be easily mounted on the prescribed position.

An air intake apparatus according to a second aspect of the present invention includes a surge tank provided in an internal-combustion engine, a valve body rotatably mounted on the surge tank, rotated between an open position and a closed position to open and close a fluid passage formed in a partition wall internally dividing the surge tank into two parts, and a valve body sealing member arranged on the outer periphery of the valve body, providing a seal between the partition wall and the valve body by coming into contact with the partition wall of the surge tank at the closed position of the valve body.

As hereinabove described, the air intake apparatus according to the second aspect of the present invention is provided with the valve body rotated between the open position and the closed position to open and close the fluid passage formed in the partition wall internally dividing the surge tank into two parts and the valve body sealing member arranged on the outer periphery of the valve body, providing a seal between the partition wall and the valve body by coming into contact with the partition wall of the surge tank at the closed position of the valve body, whereby the fluid passage (opening portion) formed in the partition wall can be closed by the valve body in a state where the valve body sealing member provides a seal between the partition wall and the valve body when the valve body is rotated to the closed position. Thus, the opening portion formed in the partition wall can be directly used as the fluid passage opened and closed by the valve body. In other words, dissimilarly to the structure in which the fluid passage formed in a frame-shaped body (frame) is opened and closed by the valve body, it is not necessary to render the opening area of the fluid passage opened and closed by the valve body smaller than the opening area of the opening portion formed in the partition wall, and hence the opening area of the fluid passage can be increased. Thus, when the valve body is so rotated to the open position that two spaces communicate with each other, the opening area of the fluid passage is increased so that the pressure loss of intake air circulating through the fluid passage can be reduced. Thus, the amount of intake air circulating through the fluid passage can be increased to improve a supercharging effect. Furthermore, no gasket may be provided on the outer peripheral surface of the frame-shaped body (frame) or a body, and hence the number of components can be reduced to simplify the structure and also simplify steps of mounting an air intake control valve.

Preferably in the aforementioned air intake apparatus according to the second aspect, the valve body is configured to rotate about a rotation shaft line, and both a first end portion and a second end portion of the valve body in the extensional direction of the rotation shaft line are configured to be rotatably supported by the surge tank. According to this structure, both the first end portion and the second end portion of the valve body are supported by only the surge tank without separately providing a member supporting the valve body such as the frame-shaped body (frame), so that the valve body can be stably rotated about the rotation shaft line.

Preferably in the aforementioned air intake apparatus according to the second aspect, the fluid passage of the partition wall of the surge tank is provided to have a shape corresponding to the outer shape of the valve body, and a sealing surface with which the valve body sealing member of the valve body comes into contact is provided along an edge portion of the fluid passage of the partition wall. According to this structure, the valve body sealing member can accurately provide a seal by coming into contact with the sealing surface provided along the edge portion of the fluid passage when the valve body is rotated to the closed position, and hence intake air can be further inhibited from leaking from a clearance between the partition wall and the valve body.

Preferably in this case, the sealing surface of the partition wall of the surge tank includes an inclined surface provided along the edge portion of the fluid passage of the partition wall of the surge tank. According to this structure, intake air circulating through the fluid passage can smoothly flow along the inclined surface, and hence the sealing surface of the partition wall can suppress increase in the pressure loss of intake air circulating through the fluid passage. Also according to this, the amount of intake air circulating through the fluid passage can be increased to improve a supercharging effect.

Preferably in the aforementioned air intake apparatus according to the second aspect, the valve body is configured to rotate about a rotation shaft line, a rotation shaft rotating together with the valve body is integrally provided on a first end portion of the valve body in the extensional direction of the rotation shaft line, a first shaft bearing is integrally provided on the second end portion of the valve body, the rotation shaft of the valve body is rotatably supported by a second shaft bearing fixed to a rotation shaft support portion provided on an outer peripheral wall of the surge tank while the first shaft bearing of the valve body is rotatably mounted on a shaft member fixed to the surge tank, and a shaft member fixing portion to fix the shaft member is provided on the partition wall of the surge tank while a concave escape portion to insert the shaft member is provided in the vicinity of the shaft member fixing portion of the partition wall. According to this structure, the shaft member can be fixed to the shaft member fixing portion through the concave escape portion to insert the shaft member in a state where the shaft center of the shaft member is brought close to the center of the partition wall in the thickness direction, and hence the rotation shaft line of the valve body can be brought close to the center of the partition wall in the thickness direction. Consequently, the valve body can be arranged in a balanced manner between the two spaces. Furthermore, it is only necessary to insert the shaft member into the first shaft bearing of the second end portion after the rotation shaft of the first end portion of the valve body is inserted into the rotation shaft support portion (rotation shaft support hole) of the surge tank, and hence the valve body can be easily mounted on the surge tank, dissimilarly to a case where rotation shafts integrally provided on both ends of the valve body are simultaneously mounted in support holes of the surge tank.

BRIEF DESCRIPTION OF THE DRAWINGS

FIG. 6 is an enlarged sectional view showing a state of supporting the first end portion side of a valve body in the air intake apparatus according to the embodiment of the present invention;

FIG. 7 is a sectional view of the valve body at an open position taken along the line VII-VII in FIG. 3;

DESCRIPTION OF THE PREFERRED EMBODIMENTS

An embodiment of the present invention is now described on the basis of the drawings.

First, the structure of an air intake apparatus 100 according to the embodiment of the present invention is described with reference to FIGS. 1 to 11.

Figure 1:
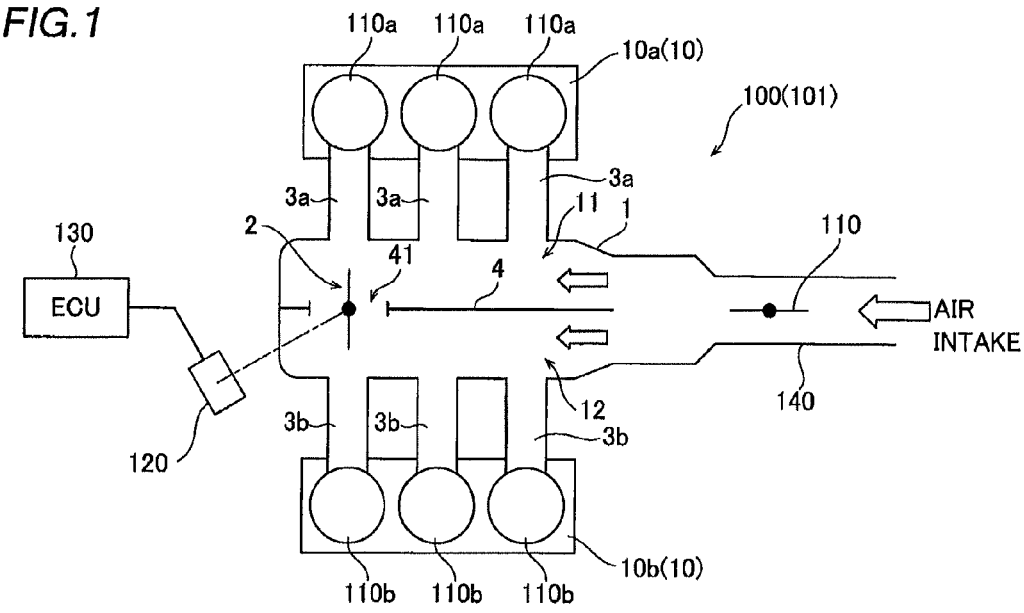
FIG. 1 is a schematic view showing an arrangement in an air intake apparatus according to an embodiment of the present invention.
Figure 2:
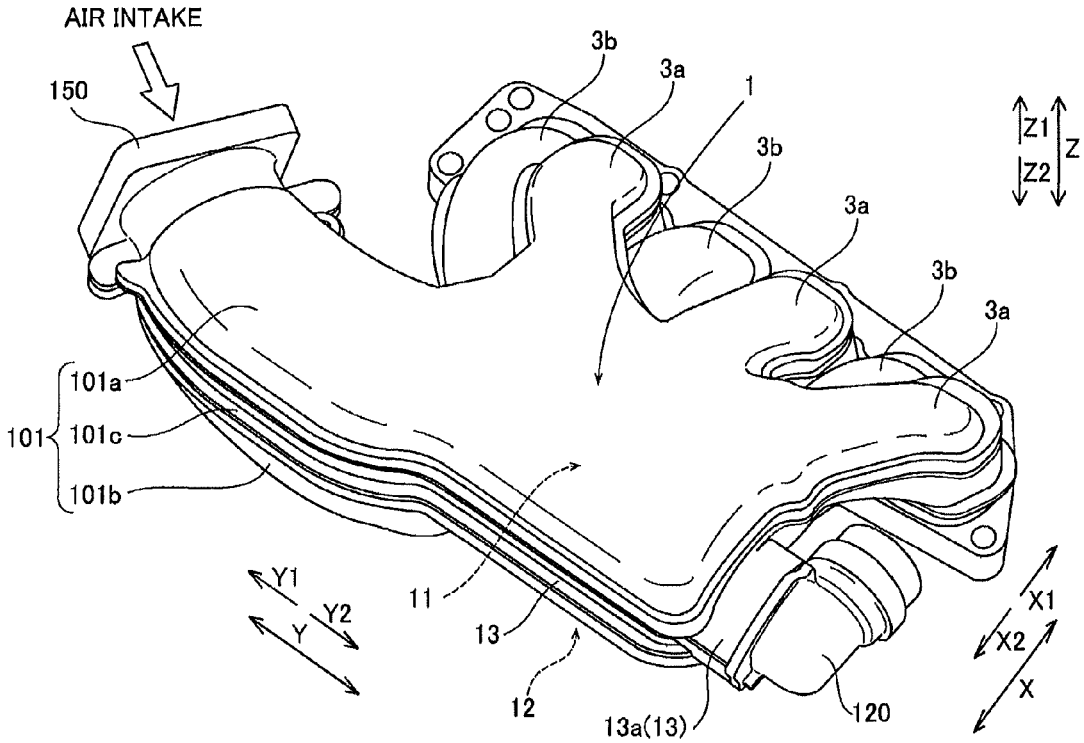
FIG. 2 is a perspective view showing the structure of the air intake apparatus according to the embodiment of the present invention.

The air intake apparatus 100 according to the embodiment of the present invention is an air intake apparatus provided in a V-type 6-cylinder engine 10 for an automobile, as shown in FIG. 1. The air intake apparatus 100 includes an air intake apparatus body 101 including a surge tank 1, an air intake control valve 2 internally provided in the surge tank 1, and three first air intake ports 3*a* and three second air intake ports 3*b* arranged on the downstream side of the surge tank 1. Structurally, the air intake apparatus 100 includes the air intake apparatus body 101 integrally including the surge tank 1 and the first and second air intake ports 3*a* and 3*b*, as shown in FIG. 2. The air intake control valve 2 (see FIG. 1) is mounted to an internal portion of the air intake apparatus body 101. The V-type 6-cylinder engine 10 is an example of the "internal-combustion engine" in the present invention.

Intake air arrived through an unshown air cleaner and a throttle 110 flows into the surge tank 1. The surge tank 1 has a partition wall 4 internally dividing the surge tank 1 into two parts of a first surge tank 11 and a second surge tank 12. The air intake control valve 2 has a function of opening and closing a fluid passage 41 including an opening portion formed in the partition wall 4. The air intake control valve 2 is configured to open and close the fluid passage 41 by the drive force of an actuator 120. The actuator 120 is configured to be driven on the basis of a signal transmitted from an ECU (engine control unit) 130.

The three first air intake ports 3*a* are configured to connect the first surge tank 11 arranged on the upper side and three cylinders 110*a* provided in a first bank 10*a* of the V-type 6-cylinder engine 10 to each other. The three second air intake ports 3*b* are configured to connect the second surge tank 12 arranged on the lower side and three cylinders 110*b* provided in a second bank 10*b* of the V-type 6-cylinder engine 10 to each other. The three cylinders 110*a* of the first bank 10*a* are a cylinder group including No. 1, No. 3, and No. 5 whose ignition timings are not consecutive, and the three cylinders 110*b* of the second bank 10*b* are a cylinder group including No. 2, No. 4, and No. 6 whose ignition timings are not consecutive. Due to the aforementioned structure, in the air intake apparatus 100 according to this embodiment, the air intake control valve 2 properly opens and closes the fluid passage 41 in response to engine rotation, whereby the resonance frequency of an air intake system can be changed to obtain an effective supercharging effect in a wide engine operation range. The structure of the air intake apparatus 100 is hereinafter described in more detail.

Figure 3:
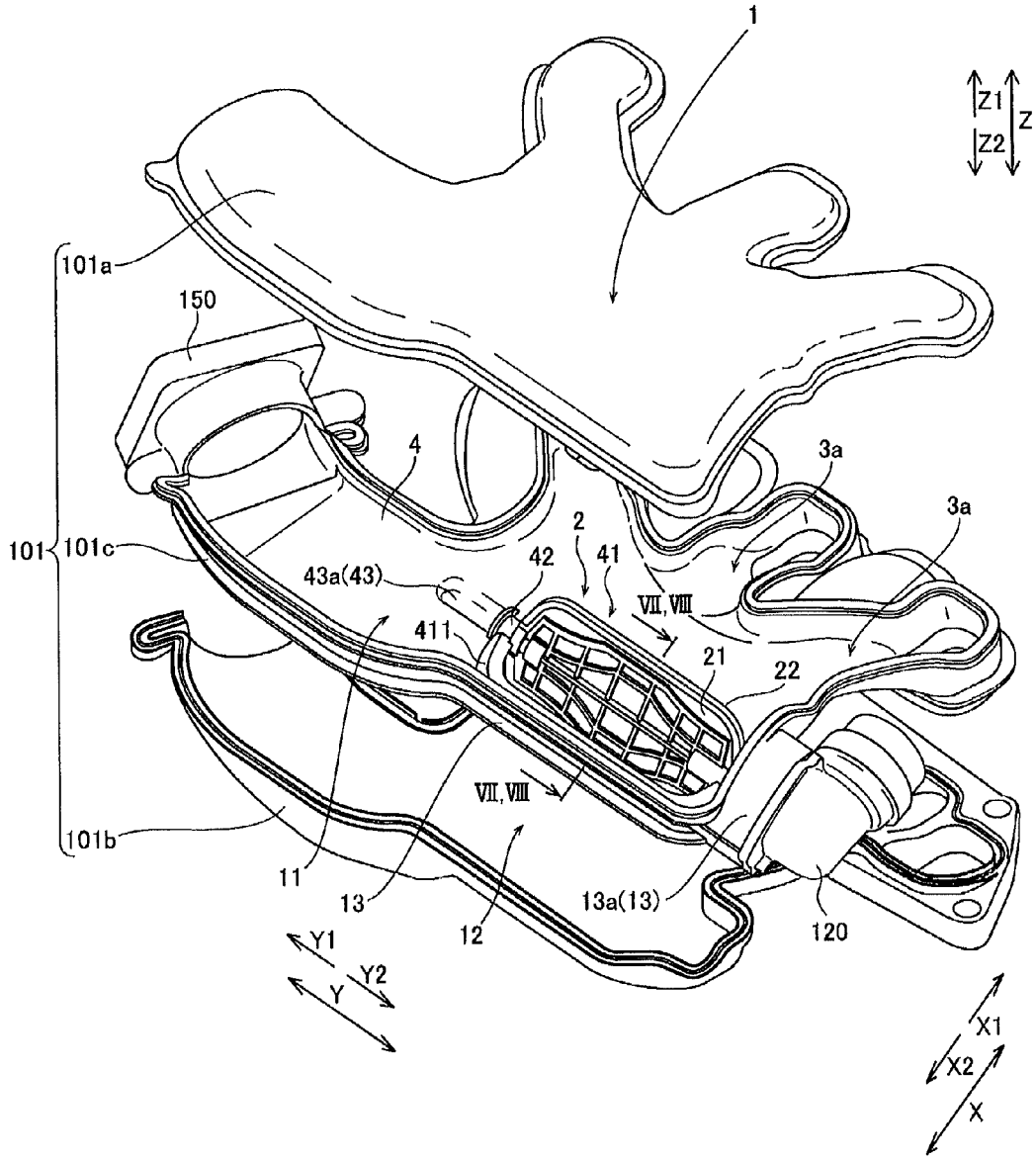
FIG. 3 is an exploded perspective view showing the structure of the air intake apparatus according to the embodiment of the present invention.

The air intake apparatus body 101 is constituted by an upper piece 101*a*, a lower piece 101*b*, and a middle piece 101*c* held between the upper piece 101*a* and the lower piece 101*b*, as shown in FIGS. 2 and 3. The upper piece 101*a*, the lower piece 101*b*, and the middle piece 101*c* are made of resin and are integrally bonded to each other by vibration welding. A connection portion 150 connected with an air intake path 140 (see FIG. 1) extending from the side of the throttle 110 is integrally formed on the intake air inflow side (Y1 direction side) of the middle piece 101*c*. The partition wall 4 of the surge tank 1 is integrally formed on the middle piece 101*c*. The first surge tank 11 and the three first air intake ports 3*a* are constituted by the upper piece 101*a* and the middle piece 101*c*, and the second surge tank 12 and the three second air intake ports 3*b* are constituted by the lower piece 101*b* and the middle piece 101*c*. The first surge tank 11 and the second surge tank 12 are arranged to overlap each other vertically (in a direction Z).

Figure 4:
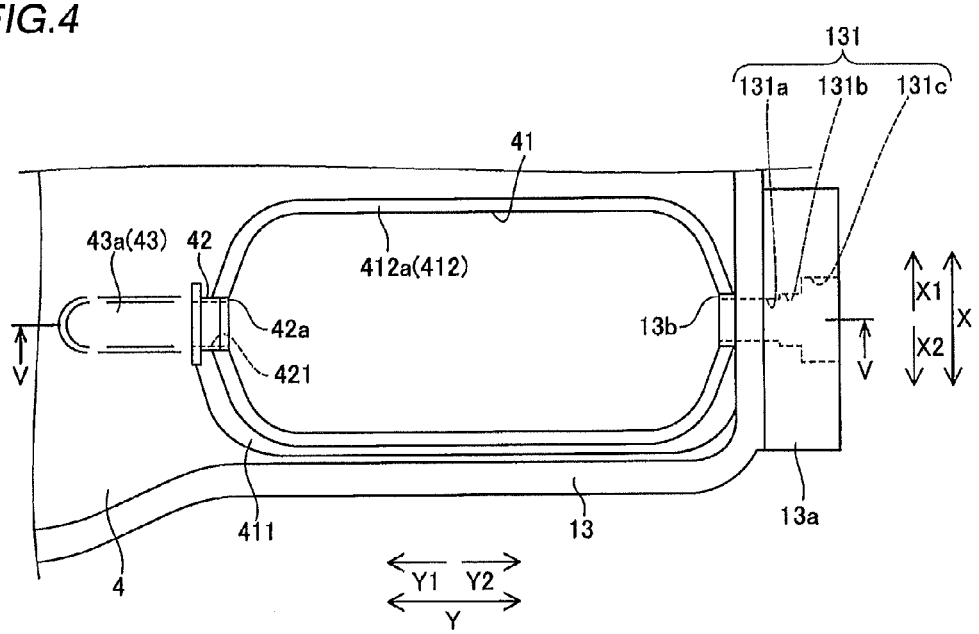
FIG. 4 is a plan view showing a fluid passage formed in a partition wall of the air intake apparatus according to the embodiment of the present invention.
Figure 5:
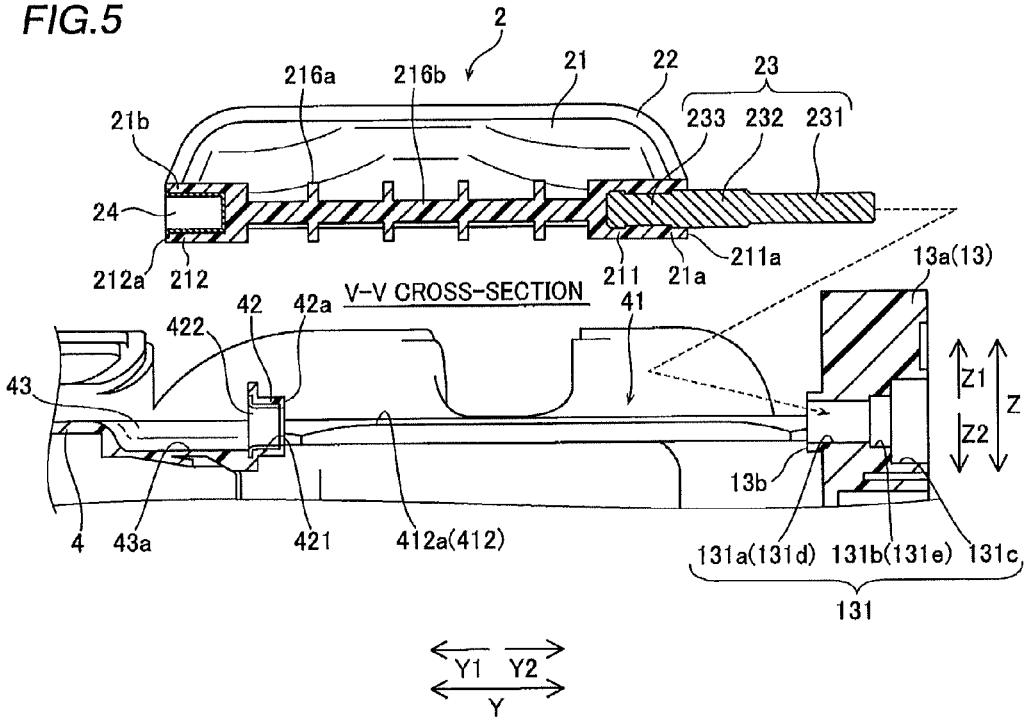
FIG. 5 is a sectional view showing the fluid passage and an air intake control valve provided in the fluid passage taken along the line V-V in FIG. 4.

The surge tank 1 is configured to rotatably support a valve body 21, described later, of the air intake control valve 2. A rotation shaft support portion 13*a* having a thickness larger than those of other portions is integrally formed at a position corresponding to the fluid passage 41 on a Y2 direction side of an outer peripheral wall 13 of the surge tank 1. The rotation shaft support portion 13*a* has a rotation shaft support hole 131 having a circular cross-section, extending in a direction Y, as shown in FIGS. 4 to 6. The rotation shaft support hole 131 is so configured that the inner diameters of a small diameter portion 131*a*, a medium diameter portion 131*b*, and a large diameter portion 131*c* are increased in a stepwise manner from the inside (Y1 direction side) of the surge tank 1 toward the outside thereof.

Figure 8:
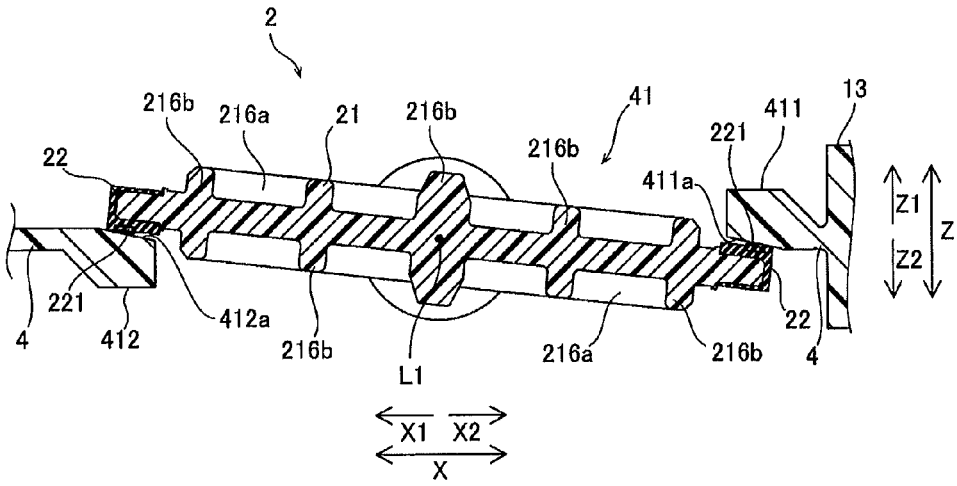
FIG. 8 is a sectional view of the valve body at a closed position taken along the line VIII-VIII in FIG. 3.

The fluid passage 41 including the opening portion formed in the partition wall 4 of the surge tank 1 is provided in the vicinity of an end portion of the surge tank 1 (on the Y2 direction side) opposite to the intake air inflow side and (on an X2 direction side) opposite to the side formed with the first air intake ports 3*a* and the second air intake ports 3*b*, as shown in FIGS. 3 and 4. The fluid passage 41 has a shape corresponding to the outer shape of the valve body 21 of the air intake control valve 2. The fluid passage 41 is in the form of an elongate hole extending in the direction Y in a plan view, as shown in FIG. 4. As shown in FIGS. 3, 4, 7, and 8, an upper projecting portion 411 projecting upward (toward the first surge tank 11) along an edge portion of the fluid passage 41 is formed on the X2 direction side of the fluid passage 41 of the partition wall 4, and a lower projecting portion 412 (see FIGS. 4, 7, and 8) projecting downward (toward the second surge tank 12) along an edge portion of the fluid passage 41 is formed on the X1 direction side of the fluid passage 41 of the partition wall 4. As shown in FIGS. 7 and 8, the upper projecting portion 411 and the lower projecting portion 412 are formed to have thicknesses larger than those of the other portions of the partition wall 4. A sealing surface 411*a* including an inclined surface upward inclined toward the inside of the fluid passage 41 is formed on the lower surface of the upper projecting portion 411, and a sealing surface 412*a* including an inclined surface downward inclined toward the inside of the fluid passage 41 is formed on the upper surface of the lower projecting portion 412. The sealing surfaces 411*a* and 412*a* are provided along the edge portions of the fluid passage 41.

Figure 9:
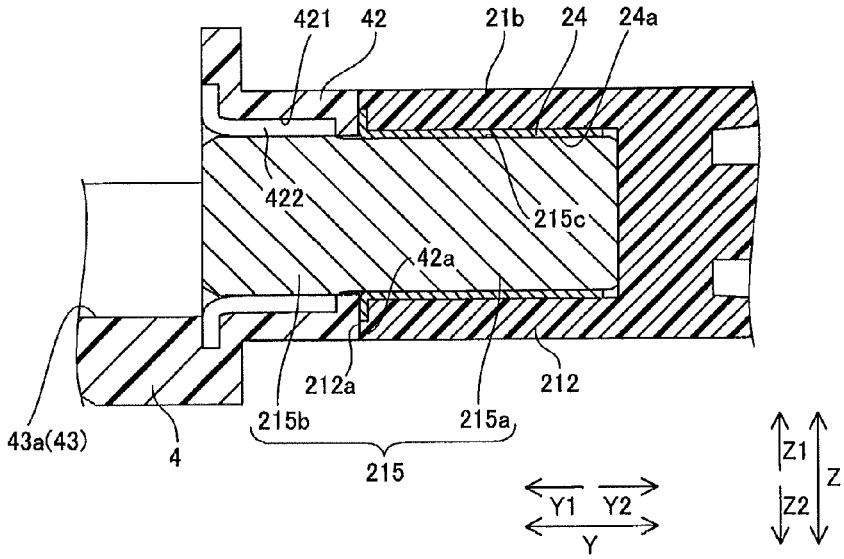
FIG. 9 is an enlarged sectional view showing a state of supporting the second end portion side of the valve body in the air intake apparatus according to the embodiment of the present invention.

As shown in FIGS. 3 to 5, a shaft member fixing portion 42 is integrally formed on the partition wall 4. The shaft member fixing portion 42 is provided on an end portion of the fluid passage 41 on the Y1 direction side. The shaft member fixing portion 42 has a shaft member support hole 421 having a circular cross-section, extending in the direction Y, as shown in FIGS. 4, 5, and 9. A bush member 422 made of metal (stainless steel, aluminum alloy, or the like, for example) is integrally provided on the shaft member support hole 421, as shown in FIGS. 5 and 9. The bush member 422 is integrally formed (insert-molded) on the partition wall 4 when the middle piece 101*c* of the surge tank 1 is resin-molded. As shown in FIGS. 3 to 5 and 9, a concave escape portion 43 to insert a shaft member 215 (see FIG. 9) described later into the shaft member fixing portion 42 is provided in the vicinity of the shaft member fixing portion 42 of the partition wall 4. The concave escape portion 43 is formed to be concave downward (toward a Z2 direction side) and extend in the direction Y. As shown in FIG. 9, the bottom surface 43*a* of the escape portion 43 is arranged at the same height position as the lower end of the shaft member support hole 421.

Figure 10:
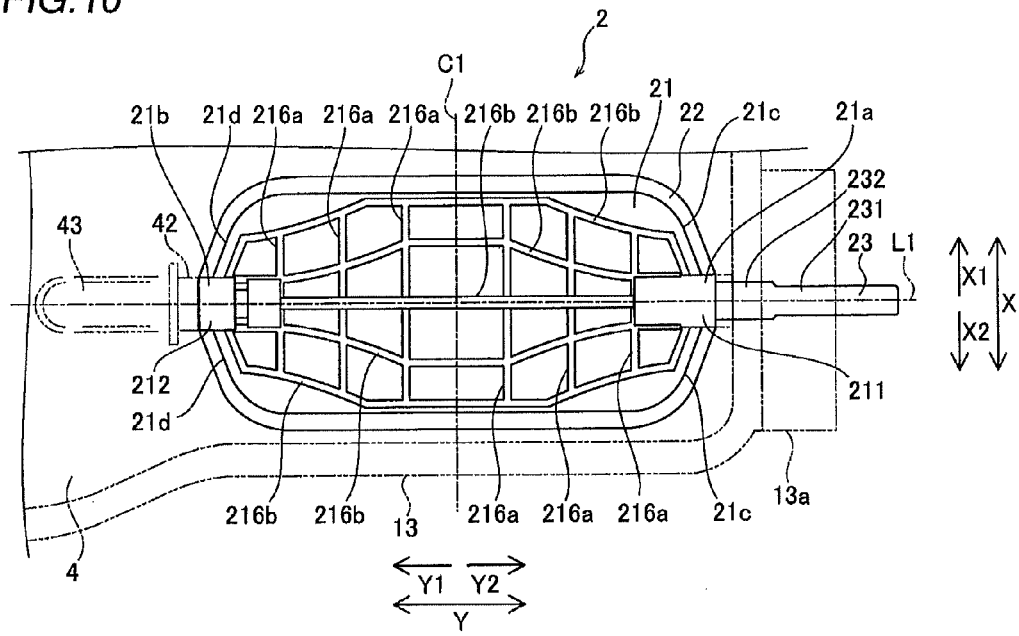
FIG. 10 is a plan view showing a state where both the first end portion and the second end portion of the valve body are supported by a surge tank in the air intake apparatus according to the embodiment of the present invention.

According to this embodiment, the air intake control valve 2 is rotatably mounted on the surge tank 1 and includes the valve body 21 rotated about a rotation shaft line L1 between an open position (position shown in FIG. 7) and a closed position (position shown in FIG. 8) to open and close the fluid passage 41 of the partition wall 4 and a valve body sealing member 22 arranged on the outer periphery of the valve body 21, as shown in FIGS. 3, 7, 8, and 10. In other words, in the air intake control valve 2 according to this embodiment, the valve body 21 is rotatably mounted directly on the surge tank 1, and no frame (body) or the like to mount the valve body 21 on the surge tank 1 is provided. The valve body 21 is so configured that both a first end portion 21*a* and a second end portion 21*b* thereof in the extensional direction (direction Y) of the rotation shaft line L1 are rotatably supported by the surge tank 1. The valve body 21 has an outer shape symmetric with respect to both the rotation shaft line L1 and a centerline C1 in a direction orthogonal to the rotation shaft line L1 in a state where both the first end portion 21*a* and the second end portion 21*b* are rotatably supported by the surge tank 1, as shown in FIG. 10. Furthermore, the valve body 21 has the outer shape corresponding to the fluid passage 41 (see FIG. 4) in a plan view. In the valve body 21, tapered portions 21*c* and 21*d* tapered toward the tips of the first end portion 21*a* and the second end portion 21*b* are provided in the vicinity of the first end portion 21*a* and the second end portion 21*b*, respectively.

Figure 11:
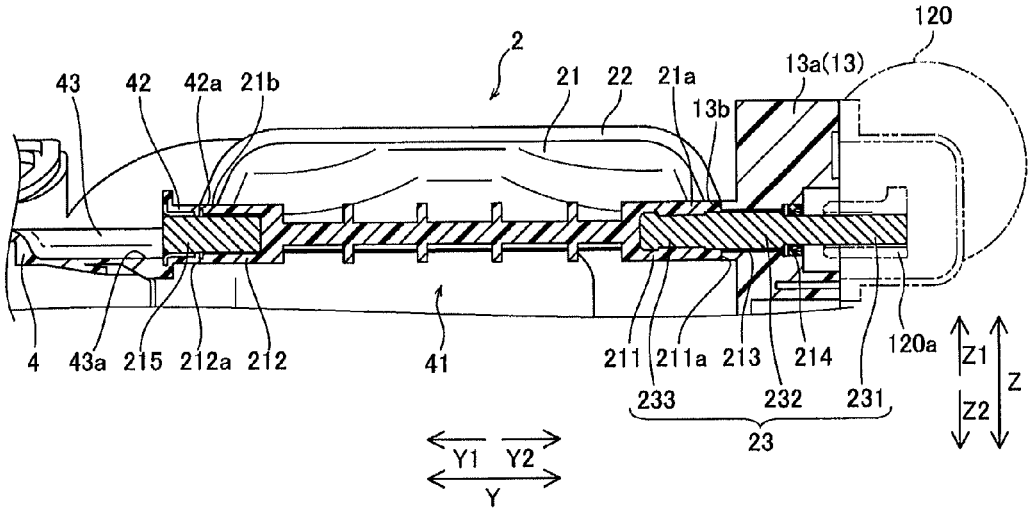
FIG. 11 is a sectional view showing a state where the air intake control valve is mounted on the surge tank in the air intake apparatus according to the embodiment of the present invention.

The valve body 21 is made of resin. As shown in FIGS. 5 and 6, a rotation shaft 23 made of metal (stainless steel, aluminum alloy, or the like, for example) rotating together with the valve body 21 is integrally provided on the first end portion 21*a* of the valve body 21. As shown in FIGS. 5 and 9, a first shaft bearing 24 made of metal (stainless steel, aluminum alloy, or the like, for example) rotating together with the valve body 21 is integrally provided on the second end portion 21*b* of the valve body 21. The rotation shaft 23 and the first shaft bearing 24 each made of metal are integrally formed (insert-molded) on the valve body 21 when the valve body 21 is resin-molded. Detailedly, a rotation shaft holding portion 211 is formed on the first end portion 21*a* of the valve body 21, and the rotation shaft 23 is configured to be held by the rotation shaft holding portion 211. A shaft bearing holding portion 212 is formed on the second end portion 21*b* of the valve body 21, and the first shaft bearing 24 is configured to be held by the shaft bearing holding portion 212. The rotation shaft holding portion 211 is so configured that the end surface 211*a* thereof on the Y2 direction side is opposed to and comes into contact with the end surface 13*b* of the rotation shaft support portion 13*a* on the Y1 direction side in a state where the valve body 21 is rotatably supported by the surge tank 1, as shown in FIGS. 6 and 11. The shaft bearing holding portion 212 is so configured that the end surface 212*a* thereof on the Y1 direction side is opposed to and comes into contact with the end surface 42*a* of the shaft member fixing portion 42 on the Y2 direction side, as shown in FIGS. 9 and 11.

The rotation shaft 23 has a thin shaft portion 231, a thick shaft portion 232 having an outer diameter larger than that of the thin shaft portion 231, and a held portion 233 held by the rotation shaft holding portion 211 in this order from a tip portion thereof projecting from the valve body 21 toward a base portion thereof, as shown in FIG. 5. The rotation shaft 23 is configured to be rotatably supported by a cylindrical second shaft bearing 213 fixed to the rotation shaft support portion 13*a* of the outer peripheral wall 13 of the surge tank 1, as shown in FIG. 6. The second shaft bearing 213 is press-fitted into a clearance between the outer peripheral surface 232*a* of the thick shaft portion 232 of the rotation shaft 23 and the inner peripheral surface 131*d* of the small diameter portion 131*a* of the rotation shaft support hole 131 to be mounted in a state where the rotation shaft 23 is inserted into the rotation shaft support hole 131 of the rotation shaft support portion 13*a*. Thus, the rotation shaft 23 is rotatably supported by the second shaft bearing 213. The second shaft bearing 213 is made of metal (stainless steel, aluminum alloy, or the like, for example), and coating to reduce a sliding resistance with the outer peripheral surface 232*a* of the thick shaft portion 232 of the rotation shaft 23 is applied to the inner peripheral surface 213*a* of the second shaft bearing 213.

In the medium diameter portion 131*b* outside the small diameter portion 131*a* of the rotation shaft support hole 131 mounted with the second shaft bearing 213, a rotation shaft sealing member 214 is mounted in a clearance between the outer peripheral surface 231*a* of the thin shaft portion 231 of the rotation shaft 23 and the inner peripheral surface 131*e* of the medium diameter portion 131*b* of the rotation shaft support hole 131. The rotation shaft sealing member 214 is annularly provided on the outer periphery of the thin shaft portion 231 of the rotation shaft 23, and has an annular inward projecting portion 214*a* projecting inward and an outward projecting portion 214*b* projecting outward. The thin shaft portion 231 of the rotation shaft 23 is so configured that the outer peripheral surface 231*a* thereof comes into line contact with the annular inward projecting portion 214*a*. The annular rotation shaft sealing member 214 has a U-shaped cross-section and is provided in a state where the open side of the U-shape faces the outside (Y2 direction side) of the surge tank 1. The outward projecting portion 214*b* is configured to annularly come into surface contact with the inner peripheral surface 131*e* of the medium diameter portion 131*b* of the rotation shaft support hole 131. Thus, outside air moving inward from the outside of the surge tank 1 can be effectively sealed. The inward projecting portion 214*a* is an example of the "projecting portion" in the present invention.

The rotation shaft 23 is provided to project outward from the rotation shaft support portion 13*a* of the outer peripheral wall 13 in a state where the valve body 21 is rotatably mounted on the surge tank 1, as shown in FIG. 11. A shaft mounting portion 120*a* of the actuator 120 rotating the rotation shaft 23 is mounted on a portion of the rotation shaft 23 projecting outward from the rotation shaft support portion 13*a*. The actuator 120 is fixed to the rotation shaft support portion 13*a* outside the surge tank 1.

The first shaft bearing 24 is configured to be rotatably supported by the shaft member 215 fixed to the shaft member fixing portion 42 of the partition wall 4, as shown in FIG. 9. The shaft member 215 is made of metal (stainless steel, aluminum alloy, or the like, for example) and has a slide portion 215*a* sliding to the first shaft bearing 24 and a press-fitted portion 215*b* having an outer diameter larger than that of the slide portion 215*a*. The press-fitted portion 215*b* having the enlarged outer diameter is press-fitted into the bush member 422 of metal provided in the shaft member support hole 421, whereby the shaft member 215 is fixed. Coating to reduce a sliding resistance with the outer peripheral surface 215*c* of the slide portion 215*a* is applied to the inner peripheral surface 24*a* of the first shaft bearing 24.

As shown in FIG. 10, a plurality of horizontal ribs 216*a* extending in a direction orthogonal to the rotation shaft line L1 and a plurality of vertical ribs 216*b* coupling the plurality of horizontal ribs 216*a* to each other are integrally formed on the front side and the rear side of the valve body 21. The plurality of horizontal ribs 216*a* are formed to extend to the vicinities of both end portions of the valve body 21 in a direction (direction X in FIG. 10) orthogonal to the longitudinal direction (direction Y) of the valve body 21 in the vicinity of a central portion of the valve body 21 in the longitudinal direction, and the farther away from the central portion in the longitudinal direction toward both end portions of the valve body 21 in the longitudinal direction, the shorter the lengths of the horizontal ribs 216*a* are. Thus, the horizontal ribs 216*a* in the central portion of the valve body 21 in the longitudinal direction are provided to elongate in the direction X, whereby the mechanical strength of the central portion of the valve body 21 in the longitudinal direction is improved.

The valve body sealing member 22 is made of an elastic member (rubber, for example) and is configured to provide a seal between the partition wall 4 and the valve body 21 by coming into contact with the partition wall 4 of the surge tank 1 at the closed position of the valve body 21. Specifically, the valve body sealing member 22 is configured to come into contact with the sealing surfaces 411*a* and 412*a* provided along the edge portions of the fluid passage 41 of the partition wall 4, as shown in FIGS. 7 and 8. The valve body sealing member 22 has protrusion portions, 221 protruding toward the sealing surfaces 411*a* and 412*a*. The valve body sealing member 22 is configured to provide a seal between the partition wall 4 and the valve body 21 in a state where the protrusion portions 221 come into contact with the scaling surfaces 411*a* and 412*a* to be squashed at the closed position of the valve body 21, as shown in FIG. 8.

Next, steps of mounting the air intake control valve 2 on the surge tank 1 are described with reference to FIGS. 5, 6, and 11 to 14.

Figure 12:
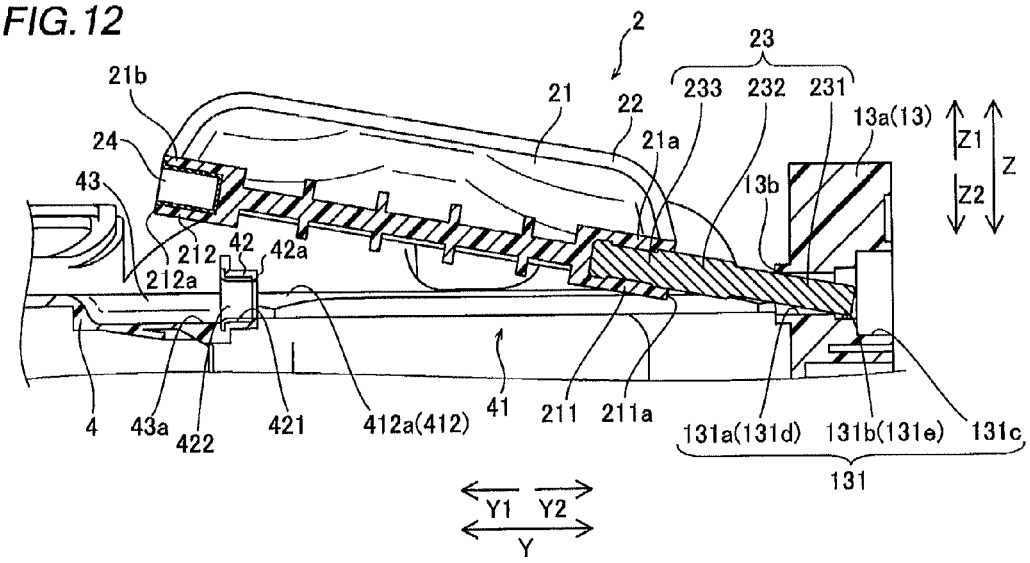
FIG. 12 is a sectional view for illustrating a step of arranging a rotation shaft at a rotation shaft support portion in mounting the air intake control valve on the surge tank in the air intake apparatus according to the embodiment of the present invention.

As shown in FIGS. 5 and 12, in a state where the rotation shaft 23 and the first shaft bearing 24 are integrally provided on the first end portion 21*a* and the second end portion 21*b* of the valve body 21, respectively and the valve body sealing member 22 is mounted on the outer periphery of the valve body 21, the thin shaft portion 231 of the rotation shaft 23 is inserted into the rotation shaft support hole 131 on which the second shaft bearing 213 has not been mounted yet while the valve body 21 is inclined. At this time, the outer diameter of the thin shaft portion 231 of the rotation shaft 23 is smaller than that of the thick shaft portion 232, so that a sufficient clearance is obtained between the thin shaft portion 231 and the inner peripheral surface 131*d* of the small diameter portion 131*a* of the rotation shaft support hole 131, and also a clearance corresponding to the plate thickness (about 1 mm, for example) of the second shaft bearing 213 is obtained between the thick shaft portion 232 of the rotation shaft 23 and the inner peripheral surface 131*d* of the small diameter portion 131*a* of the rotation shaft support hole 131. Therefore, the rotation shaft 23 can be easily inserted into the rotation shaft support hole 131 while the valve body 21 is inclined.

Figure 13:
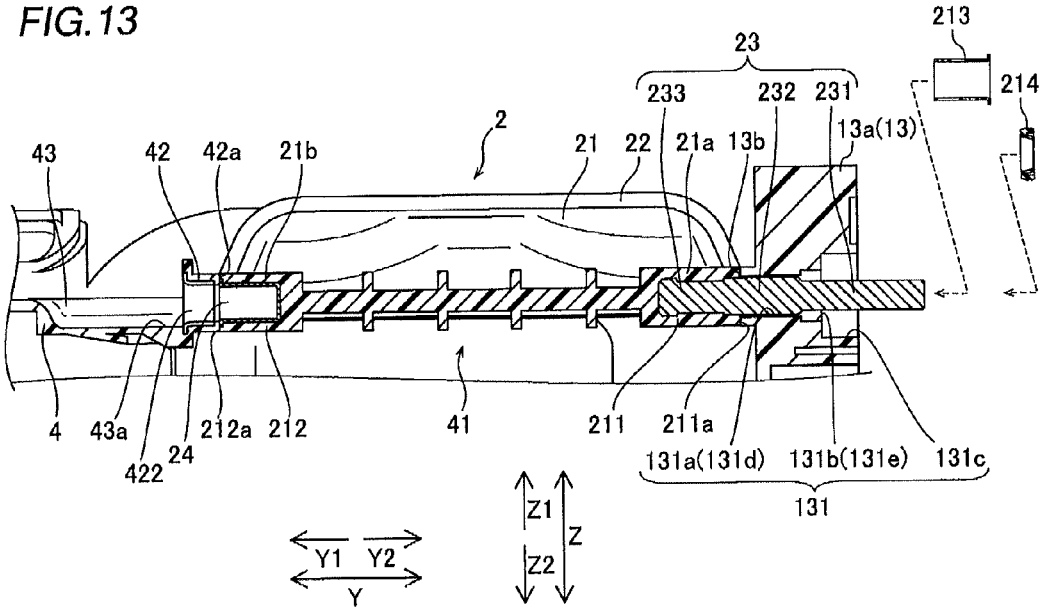
FIG. 13 is a sectional view for illustrating a step of fitting a second shaft bearing and a rotation shaft sealing member to the first end portion of the valve body in mounting the air intake control valve on the surge tank in the air intake apparatus according to the embodiment of the present invention.

As shown in FIGS. 12 and 13, the second end portion 21*b* provided with the first shaft bearing 24 is inserted into the fluid passage 41 while the valve body 21 is inclined in the state where the rotation shaft 23 of the first end portion 21*a* of the valve body 21 is inserted into the rotation shaft support hole 131. Thus, the rotation shaft holding portion 211 of the valve body 21 is opposed to and comes into contact with the rotation shaft support portion 13*a* of the outer peripheral wall 13 of the surge tank 1, and the shaft bearing holding portion 212 is opposed to and comes into contact with the shaft member fixing portion 42 of the partition wall 4.

Figure 14:
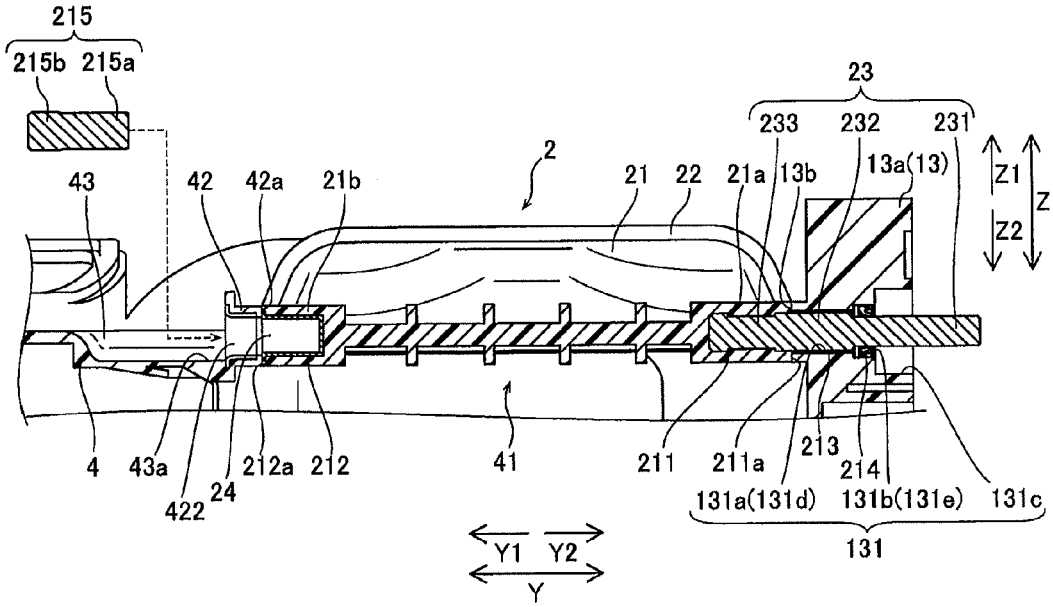
FIG. 14 is a sectional view for illustrating a step of inserting a shaft member into the second end portion of the valve body in mounting the air intake control valve on the surge tank in the air intake apparatus according to the embodiment of the present invention.

Thereafter, the second shaft bearing 213 is press-fitted into the clearance between the outer peripheral surface 232*a* (see FIG. 6) of the thick shaft portion 232 of the rotation shaft 23 and the inner peripheral surface 131*d* of the small diameter portion 131*a* of the rotation shaft support hole 131 on the side of the first end portion 21*a* of the valve body 21, as shown in FIG. 13. Then, the annular rotation shaft sealing member 214 is fitted into the clearance between the outer peripheral surface 231*a* (see FIG. 6) of the thin shaft portion 231 of the rotation shaft 23 and the inner peripheral surface 131*e* of the medium diameter portion 131*b* of the rotation shaft support hole 131. Thereafter, on the side of the second end portion 21*b* of the valve body 21, utilizing the internal space of the concave escape portion 43 of the partition wall 4, the shaft member 215 is slid along the rotation shaft line L1 of the valve body 21 (along the direction Y), and the press-fitted portion 215*b* is press-fitted into the bush member 422 integrally provided on the shaft member fixing portion 42, as shown in FIG. 14. At this time, the shaft member 215 is inserted from the side of the slide portion 215*a*, and is pushed toward the Y2 direction side until the slide portion 215*a* reaches a position of the valve body 21 corresponding to the first shaft bearing 24. Thus, both the first end portion 21*a* and the second end portion 21*b* of the valve body 21 are rotatably supported by the surge tank 1. Thereafter, the shaft mounting portion 120*a* of the actuator 120 rotating the rotation shaft 23 is mounted on the portion of the rotation shaft 23 projecting outward from the rotation shaft support portion 13*a* from the outside of the surge tank 1, as shown in FIG. 11. In this manner, the air intake control valve 2 is mounted on the surge tank 1.

According to this embodiment, as hereinabove described, the air intake apparatus 100 is provided with the valve body 21 rotated between the open position and the closed position to open and close the fluid passage 41 formed in the partition wall 4 internally dividing the surge tank 1 into two parts and the valve body sealing member 22 arranged on the outer periphery of the valve body 21, providing a seal between the partition wall 4 and the valve body 21 by coming into contact with the partition wall 4 of the surge tank 1 at the closed position of the valve body 21, whereby the fluid passage 41 (opening portion) formed in the partition wall 4 can be closed by the valve body 21 in a state where the valve body sealing member 22 provides a seal between the partition wall 4 and the valve body 21 when the valve body 21 is rotated to the closed position. Thus, the opening portion formed in the partition wall 4 can be directly used as the fluid passage 41 opened and closed by the valve body 21. In other words, dissimilarly to the structure in which the fluid passage 41 formed in a frame-shaped body (frame) is opened and closed by the valve body 21, it is not necessary to render the opening area of the fluid passage 41 opened and closed by the valve body 21 smaller than the opening area of the opening portion formed in the partition wall 4, and hence the opening area of the fluid passage 41 can be increased. Thus, when the valve body 21 is so rotated to the open position that two spaces communicate with each other, the opening area of the fluid passage 41 is increased so that the pressure loss of intake air circulating through the fluid passage 41 can be reduced. Thus, the amount of intake air circulating through the fluid passage 41 can be increased to improve a supercharging effect. Furthermore, no gasket may be provided on the outer peripheral surface of the frame-shaped body (frame) or a body, and hence the number of components can be reduced to simplify the structure and also simplify the steps of mounting the air intake control valve 2.

According to this embodiment, as hereinabove described, the valve body sealing member 22 is configured to come into contact with the sealing surfaces 411*a* and 412*a* provided along the edge portions of the fluid passage 41 of the partition wall 4 of the surge tank 1. Thus, the valve body sealing member 22 can accurately provide a seal by coming into contact with the sealing surfaces 411*a* and 412*a* of the partition wall 4 when the valve body 21 is rotated to the closed position, and hence intake air can be further inhibited from leaking from a clearance between the partition wall 4 and the valve body 21.

According to this embodiment, as hereinabove described, the valve body 21 is so configured that both the first end portion 21*a* and the second end portion 21*b* thereof in the extensional direction (direction Y) of the rotation shaft line L1 are rotatably supported by the surge tank 1. Thus, both the first end portion 21*a* and the second end portion 21*b* of the valve body 21 are supported by only the surge tank 1 without separately providing a member supporting the valve body 21 such as the frame-shaped body (frame), so that the valve body 21 can be stably rotated about the rotation shaft line L1.

According to this embodiment, as hereinabove described, the first end portion 21*a* of the valve body 21 is rotatably supported by the outer peripheral wall 13 of the surge tank 1, and the second end portion 21*b* of the valve body 21 is rotatably supported by the partition wall 4 of the surge tank 1. Thus, both end portions of the valve body 21 can be easily rotatably supported by utilizing the outer peripheral wall 13 and the partition wall 4 of the surge tank 1.

According to this embodiment, as hereinabove described, the valve body 21 is formed to have the shape symmetric with respect to both the rotation shaft line L1 and the centerline C1 in the direction orthogonal to the rotation shaft line L1 in the state where both the first end portion 21*a* and the second end portion 21*b* of the valve body 21 are rotatably supported by the surge tank 1. Thus, the plane area of the valve body 21 can be effectively increased in the surge tank 1 having a limited space, and hence the opening area of the fluid passage 41 opened and closed by the valve body 21 can be further increased. Consequently, the amount of intake air circulating through the fluid passage 41 can be further increased when the valve body 21 is so rotated to the open position that the two spaces communicate with each other, and hence a supercharging effect can be further improved. Furthermore, the weight of the valve body 21 can be symmetrically allocated in both the extensional direction (direction Y) of the rotation shaft line L1 and the direction orthogonal to the rotation shaft line L1, and hence the valve body 21 can be more stably rotated in the opening and closing operation of the valve body 21.

According to this embodiment, as hereinabove described, the rotation shaft 23 and the first shaft bearing 24 are integrally provided on the first end portion 21*a* and the second end portion 21*b* of the valve body 21, respectively. Thus, the steps of mounting the air intake control valve 2 can be simplified as compared with a case where the rotation shaft 23 and the first shaft bearing 24 are provided separately from the valve body 21.

According to this embodiment, as hereinabove described, the rotation shaft 23 of the valve body 21 is rotatably supported by the second shaft bearing 213 fixed to the rotation shaft support portion 13*a* provided on the outer peripheral wall 13 of the surge tank 1, and the first shaft bearing 24 of the valve body 21 is rotatably supported by the shaft member 215 fixed to the shaft member fixing portion 42 of the partition wall 4 of the surge tank 1. Thus, it is only necessary to insert the shaft member 215 into the first shaft bearing 24 of the second end portion 21*b* after the rotation shaft 23 of the first end portion 21*a* of the valve body 21 is inserted into the rotation shaft support portion 13*a* (rotation shaft support hole 131) of the surge tank 1, and hence the valve body 21 can be easily mounted on the surge tank 1, dissimilarly to a case where rotation shafts integrally provided on both ends of the valve body 21 are simultaneously mounted in support holes of the surge tank 1.

According to this embodiment, as hereinabove described, the rotation shaft 23 and the first shaft bearing 24 each made of metal are integrally formed on the valve body 21 when the valve body 21 is resin-molded. Thus, the rotation shaft 23 and the first shaft bearing 24 each made of metal excellent in wear resistance can be easily integrally provided on the first end portion 21*a* and the second end portion 21*b* of the valve body 21 made of resin, respectively, and hence the valve body 21 can be inhibited from being unstably rotated due to wear of the rotation shaft 23 and the first shaft bearing 24, dissimilarly to a case where the rotation shaft 23 and the first shaft bearing 24 are made of the same resin as the valve body 21 and are integrally formed on the valve body 21.

According to this embodiment, as hereinabove described, the second shaft bearing 213 is inserted into and mounted in the clearance between the outer peripheral surface 232*a* of the rotation shaft 23 and the inner peripheral surface 131*d* of the rotation shaft support hole 131 in the state where the rotation shaft 23 is inserted into the rotation shaft support hole 131 of the rotation shaft support portion 13*a*, so that the rotation shaft 23 is rotatably supported by the second shaft bearing 213. Thus, the rotation shaft 23 of the valve body 21 is rotatably supported by the second shaft bearing 213 in a state where the second shaft bearing 213 fills the clearance between the outer peripheral surface 232*a* of the rotation shaft 23 and the inner peripheral surface 131*d* of the rotation shaft support hole 131, and hence backlash of the rotation shaft 23 is suppressed, so that the valve body 21 can be stably rotated. Furthermore, the inner diameter of the rotation shaft support hole 131 can be rendered larger than the outer diameter of the rotation shaft 23, and hence the rotation shaft 23 can be easily inserted into the rotation shaft support hole 131 in a state where the second shaft bearing 213 of the valve body 21 is not inserted.

According to this embodiment, as hereinabove described, the rotation shaft sealing member 214 is mounted in the clearance between the outer peripheral surface 231*a* of the rotation shaft 23 and the inner peripheral surface 131*e* of the rotation shaft support hole 131 outside a portion of the rotation shaft support hole 131 mounted with the second shaft bearing 213. Thus, the rotation shaft sealing member 214 arranged outside the second shaft bearing 213 can prevent outside air from flowing into the surge tank 1 from the outside through the clearance between the outer peripheral surface 231*a* of the rotation shaft 23 and the inner peripheral surface 131*e* of the rotation shaft support hole 131, and hence an air-fuel ratio can be inhibited from deviating from a designed value due to inflow of outside air.

According to this embodiment, as hereinabove described, the rotation shaft 23 is so configured that the outer peripheral surface 231*a* thereof comes into line contact with the annular inward projecting portion 214*a* of the rotation shaft sealing member 214. Thus, the contact area between the outer peripheral surface 231*a* of the rotation shaft 23 and the rotation shaft sealing member 214 can be reduced as compared with a case where the rotation shaft sealing member 214 comes into surface contact with the outer peripheral surface 231*a* of the rotation shaft 23, and hence the rotational resistance of the rotation shaft 23 can be inhibited from increasing due to contact with the rotation shaft sealing member 214.

According to this embodiment, as hereinabove described, the bush member 422 made of metal is integrally provided on the shaft member fixing portion 42 of the partition wall 4, and the first shaft bearing 24 of the valve body 21 is rotatably supported by the shaft member 215 fixed by being press-fitted into the bush member 422 made of metal. Thus, the shaft member 215 supporting the first shaft bearing 24 of the valve body 21 can be tightly fixed by the bush member 422 made of metal that is hard to deform (expand and contract), and hence the tightly fixed shaft member 215 can stably support the first shaft bearing 24 of the valve body 21.

According to this embodiment, as hereinabove described, the actuator 120 rotating the rotation shaft 23 is mounted on the portion of the rotation shaft 23 projecting outward from the rotation shaft support portion 13*a* of the surge tank 1 in the state where the valve body 21 is rotatably mounted on the surge tank 1. Thus, the actuator 120 arranged outside the surge tank 1 can easily rotate the valve body 21 rotatably supported by the surge tank 1 in the surge tank 1.

According to this embodiment, as hereinabove described, the rotation shaft holding portion 211 holding the rotation shaft 23, being opposed to and coming into contact with the rotation shaft support portion 13*a* and the shaft bearing holding portion 212 holding the first shaft bearing 24, being opposed to and coming into contact with the shaft member fixing portion 42 of the partition wall 4 are provided in the valve body 21. Thus, intake air can be inhibited from leaking from clearances between the rotation shaft support portion 13*a* of the surge tank 1 and the rotation shaft holding portion 211 of the valve body 21 and between the shaft member fixing portion 42 of the partition wall 4 and the shaft bearing holding portion 212 of the valve body 21 without providing sealing members therebetween.

According to this embodiment, as hereinabove described, the tapered portion 21*d* tapered toward the tip of the second end portion 21*b* is provided in the vicinity of the second end portion 21*b* of the valve body 21 integrally provided with the first shaft bearing 24. Thus, the amount of protrusion of a corner portion closer to the second end portion 21*b* is reduced by the tapered portion 21*d*, and hence when the valve body 21 is mounted on a prescribed position of the fluid passage 41, the second end portion 21*b* provided with the first shaft bearing 24 can be easily inserted into the fluid passage 41 while the valve body 21 is inclined even after the rotation shaft 23 provided on the first end portion 21*a* is arranged on the rotation shaft support portion 13*a* of the surge tank 1. Thus, the valve body 21 can be easily mounted on the prescribed position.

According to this embodiment, as hereinabove described, the sealing surfaces 411*a* and 412*a* of the partition wall 4 of the surge tank 1 include the inclined surfaces provided along the edge portions of the fluid passage 41 of the partition wall 4 of the surge tank 1. Thus, intake air circulating through the fluid passage 41 can smoothly flow along the inclined surfaces, and hence the sealing surfaces 411*a* and 412*a* of the partition wall 4 can suppress increase in the pressure loss of intake air circulating through the fluid passage 41. Also according to this, the amount of intake air circulating through the fluid passage 41 can be increased to improve a supercharging effect.

According to this embodiment, as hereinabove described, the concave escape portion 43 to insert the shaft member 215 is provided in the vicinity of the shaft member fixing portion 42 of the partition wall 4. Thus, the shaft member 215 can be fixed to the shaft member fixing portion 42 through the concave escape portion 43 to insert the shaft member 215 in a state where the shaft center of the shaft member 215 is brought close to the center of the partition wall 4 in the thickness direction (direction Z), and hence the rotation shaft line L1 of the valve body 21 can be brought close to the center of the partition wall 4 in the thickness direction. Consequently, the valve body 21 can be arranged in a balanced manner between the two spaces.

The embodiment disclosed this time must be considered as illustrative in all points and not restrictive. The range of the present invention is shown not by the above description of the embodiment but by the scope of claims for patent, and all modifications within the meaning and range equivalent to the scope of claims for patent are included.

For example, while the example of applying the air intake control valve and the air intake apparatus according to the present invention to the V-type 6-cylinder engine for an automobile has been shown in the aforementioned embodiment, the present invention is not restricted to this. The air intake control valve and the air intake apparatus according to the present invention may be applied to an internal-combustion engine other than the automobile engine, or the air intake control valve and the air intake apparatus according to the present invention may be applied to a V-type multi-cylinder engine, a straight engine, or the like other than the V-type 6-cylinder engine.

While the example of arranging the first surge tank and the second surge tank separated by the partition wall parallel to each other (adjacent to each other) in the vertical direction has been shown in the aforementioned embodiment, the present invention is not restricted to this. According to the present invention, the first surge tank and the second surge tank may be arranged parallel to each other (adjacent to each other) in the horizontal direction, or the first surge tank and the second surge tank may be arranged parallel to each other (adjacent to each other) in a direction other than the vertical direction and the horizontal direction.

While the example of integrally providing the rotation shaft on the first end portion (end portion on the Y2 direction side) of the valve body and integrally providing the first shaft bearing on the second end portion (end portion on the Y1 direction side) of the valve body has been shown in the aforementioned embodiment, the present invention is not restricted to this. According to the present invention, the first shaft bearing may be integrally provided on the first end portion of the valve body, and the rotation shaft may be integrally provided on the second end portion of the valve body. Alternatively, rotation shafts may be integrally provided on both the first end portion and the second end portion of the valve body.

While the example of making the valve body of resin and making the rotation shaft, the first shaft bearing, the second shaft bearing, the shaft member, and the bush member of metal has been shown in the aforementioned embodiment, the present invention is not restricted to this. According to the present invention, the valve body may be made of a material other than resin, such as metal, or the rotation shaft, the first shaft bearing, the second shaft bearing, the shaft member, and the bush member may be made of a material other than metal, such as resin.

Figure 15:
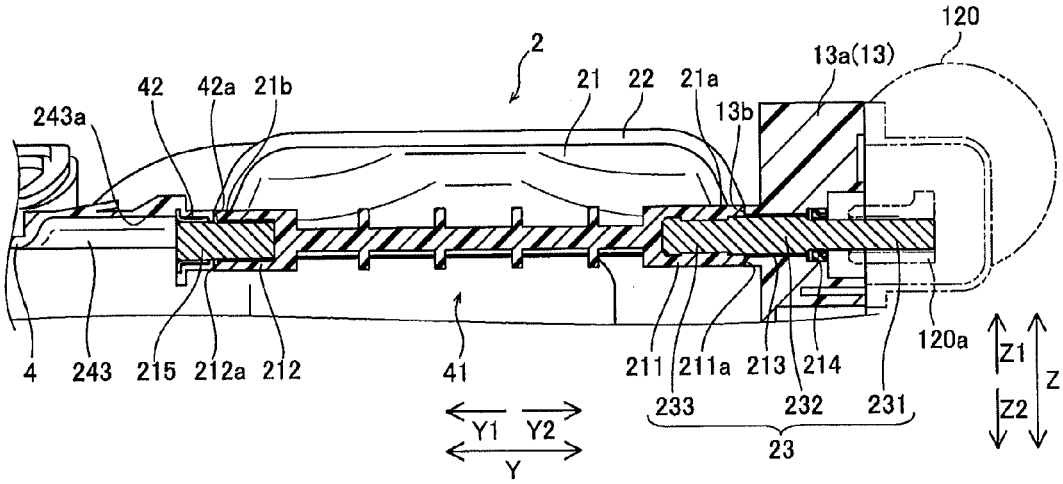
FIG. 15 is a sectional view showing a modification in which an escape portion of the air intake apparatus according to the embodiment of the present invention is concave upward.

While the example of forming the concave escape portion to be concave downward (toward the Z2 direction side) has been shown in the aforementioned embodiment, the present invention is not restricted to this. According to the present invention, a concave escape portion 243 may be formed to be concave upward (toward a Z1 direction side) so that the inner surface 243*a* thereof has a convex shape on the upper side, as in a modification shown in FIG. 15. According to this structure, an extraneous material such as oil can be inhibited from accumulating in the concave escape portion 243, and hence the valve body can be inhibited from being unstably rotated in the opening and closing operation of the valve body due to accumulation of the extraneous material such as oil. Furthermore, even if the concave escape portion is formed to be concave downward (toward the Z2 direction side) as in the aforementioned embodiment, the extraneous material such as oil can be inhibited from accumulating in the concave escape portion by reducing (shallowing) the depth of the concave escape portion.

While the example of integrally providing the rotation shaft support portion and the shaft member fixing portion on the surge tank has been shown in the aforementioned embodiment, the present invention is not restricted to this. According to the present invention, each of the rotation shaft support portion and the shaft member fixing portion may be provided separately from the surge tank. Alternatively, either the rotation shaft support portion or the shaft member fixing portion may be integrally provided on the surge tank, and either the shaft member fixing portion or the rotation shaft support portion may be provided separately from the surge tank.

What is claimed is:

1. An air intake control valve comprising:

a valve body rotatably mounted on a surge tank of an internal-combustion engine, rotated between an open position and a closed position to open and close a fluid passage formed in a partition wall internally dividing the surge tank into two parts;

a valve body sealing member arranged on an outer periphery of the valve body, providing a seal between the partition wall and the valve body by coming into contact with the partition wall of the surge tank at the closed position of the valve body;

the valve body being configured to rotate about a rotation shaft line, and both a first end portion and a second end portion of the valve body in an extensional direction of the rotation shaft line are rotatably supported by the surge tank;

the first end portion of the valve body being rotatably supported by an outer peripheral wall of the surge tank; and the second end portion of the valve body being rotatably supported by the partition wall of the surge tank.

2. The air intake control valve according to claim 1, wherein the valve body sealing member is configured to come into contact with a sealing surface provided along an edge portion of the fluid passage of the partition wall of the surge tank.

3. The air intake control valve according to claim 1, wherein the valve body has a shape symmetric with respect to both the rotation shaft line and a centerline in a direction orthogonal to the rotation shaft line and a centerline in a direction orthogonal to the rotation shaft line in a state where both the first end portion and the second end portion of the valve body are rotatably supported by the surge tank.

4. The air intake control valve according to claim 1, wherein either a rotation shaft or a shaft bearing is integrally provided on each of the first end portion and the second end portion of the valve body.

5. The air intake control valve according to claim 4, wherein the rotation shaft rotating together with the valve body is integrally provided on the first end portion of the valve body, a first shaft bearing is integrally provided on the second end portion of the valve body, and the rotation shaft of the valve body is rotatably supported by a second shaft bearing fixed to a rotation shaft support portion provided on the outer peripheral wall of the surge tank while the first shaft bearing of the valve body is rotatably supported by a shaft member fixed to a shaft member fixing portion of the partition wall of the surge tank.

6. The air intake control valve according to claim 5, wherein the valve body is made of resin, and both the rotation shaft and the first shaft bearing are made of metal and are integrally formed on the valve body when the valve body is resin-molded.

7. The air intake control valve according to claim 5, wherein the second shaft bearing is inserted into and mounted in a clearance between an outer peripheral surface of the rotation shaft and an inner peripheral surface of the rotation shaft support hole in a state where the rotation shaft is inserted into a rotation shaft support hole of the rotation shaft support portion, so that the rotation shaft is rotatably supported by the second shaft bearing.

8. The air intake control valve according to claim 7, wherein a rotation shaft sealing member is mounted in the clearance between the outer peripheral surface of the rotation shaft and the inner peripheral surface of the rotation shaft support hole outside a portion of the rotation shaft support hole mounted with the second shaft bearing.

9. The air intake control valve according to claim 8, wherein the rotation shaft is so configured that the outer peripheral surface of the rotation shaft comes into line contact with an annular projecting portion of the rotation shaft sealing member.

10. The air intake control valve according to claim 5, wherein a bush member made of metal is integrally provided on the shaft member fixing portion of the partition wall, and the first shaft bearing of the valve body is rotatably supported by the shaft member fixed by being press-fitted into the bush member made of metal.

11. The air intake control valve according to claim 5, wherein the rotation shaft of the valve body is provided to project outward from the rotation shaft support portion of the outer peripheral wall of the surge tank in a state where the rotation shaft is rotatably mounted on the surge tank, and an actuator rotating the rotation shaft is mounted on a portion of the rotation shaft projecting outward from the rotation shaft support portion of the surge tank.

12. The air intake control valve according to claim 5, wherein the valve body includes:

a rotation shaft holding portion holding the rotation shaft, being opposed to and coming into contact with the rotation shaft support portion, and a shaft bearing holding portion holding the first shaft bearing, being opposed to and coming into contact with the shaft member fixing portion of the partition wall.

13. The air intake control valve according to claim 5, wherein a tapered portion tapered toward a tip of the second end portion is provided at least in a vicinity of the second end portion of the valve body integrally provided with the first shaft bearing.

14. An air intake apparatus comprising:

a surge tank provided in an internal-combustion engine;

a valve body rotatably mounted on the surge tank, rotated between an open position and a closed position to open and close a fluid passage formed in a partition wall internally dividing the surge tank into two parts;

a valve body sealing member arranged on an outer periphery of the valve body, providing a seal between the partition wall and the valve body by coming into contact with the partition wall of the surge tank at the closed position of the valve body;

the valve body being configured to rotate about a rotation shaft line, and both a first end portion and a second end portion of the valve body in an extensional direction of the rotation shaft line are rotatably supported by the surge tank;

the first end portion of the valve body being rotatably supported by an outer peripheral wall of the surge tank; and the second end portion of the valve body being rotatably supported by the partition wall of the surge tank.

15. The air intake apparatus according to claim 14, wherein the fluid passage of the partition wall of the surge tank is provided to have a shape corresponding to an outer shape of the valve body, and a sealing surface with which the valve body sealing member of the valve body comes into contact is provided along an edge portion of the fluid passage of the partition wall.

16. The air intake apparatus according to claim 15, wherein the sealing surface of the partition wall of the surge tank includes an inclined surface provided along the edge portion of the fluid passage of the partition wall of the surge tank.

17. The air intake apparatus according to claim 14, wherein a rotation shaft rotating together with the valve body is integrally provided on the first end portion of the valve body in an extensional direction of the rotation shaft line, a first shaft bearing is integrally provided on the second end portion of the valve body, the rotation shaft of the valve body is rotatably supported by a second shaft bearing fixed to a rotation shaft support portion provided on the outer peripheral wall of the surge tank while the first shaft bearing of the valve body is rotatably mounted on a shaft member fixed to the surge tank, and a shaft member fixing portion to fix the shaft member is provided on the partition wall of the surge tank while a concave escape portion to insert the shaft member is provided in a vicinity of the shaft member fixing portion of the partition wall.

18. An air intake control valve comprising:

a valve body rotatably mounted on a surge tank of an internal-combustion engine, rotated between an open position and a closed position to open and close a fluid passage formed in a partition wall internally dividing the surge tank into two parts, the valve body being configured to rotate about a rotation shaft line and possessing both a first end portion and a second end portion, a valve body sealing member arranged on an outer periphery of the valve body, providing a seal between the partition wall and the valve body by coming into contact with the partition wall of the surge tank at the closed position of the valve body, a rotation shaft rotatable together with the valve body is integrally provided on the first end portion of the valve body, a first shaft bearing is integrally provided on the second end portion of the valve body, and the rotation shaft of the valve body is rotatably supported by a second shaft bearing fixed to a rotation shaft support portion provided on an outer peripheral wall of the surge tank while the first shaft bearing of the valve body is rotatably supported by a shaft member fixed to a shaft member fixing portion of the partition wall of the surge tank.

* * * * *